US005323856A

United States Patent [19]

Davis et al.

[11] Patent Number: 5,323,856

[45] Date of Patent: Jun. 28, 1994

[54] DETECTING SYSTEM AND METHOD FOR OIL OR GAS WELL

[75] Inventors: James L. Davis, Marlow; Charles F. Van Berg, Jr., Duncan, both of Okla.

[73] Assignee: Halliburton Company, Duncan, Okla.

[21] Appl. No.: 40,708

[22] Filed: Mar. 31, 1993

[51] Int. Cl.[5] ..... E21B 44/00

[52] U.S. Cl. ..... 166/253; 175/45

[58] Field of Search ..... 166/250, 285, 253, 255; 175/45

[56] References Cited

U.S. PATENT DOCUMENTS

| | | | |
|---|---|---|---|
| 2,201,311 | 5/1940 | Halliburton | 181/0.5 |
| 3,116,452 | 12/1963 | Schmidt | 324/40 |
| 3,562,636 | 2/1971 | Huber | 324/34 |
| 3,684,961 | 8/1972 | Miur | 324/34 D |
| 3,694,740 | 9/1972 | Bergstrand | 324/37 |
| 3,843,923 | 10/1974 | DeVries et al. | 324/34 R |
| 3,878,453 | 4/1975 | Potter et al. | 324/3 |
| 3,883,797 | 5/1975 | Abrukin | 324/37 |
| 4,023,092 | 5/1977 | Rogers | 324/34 R |
| 4,038,609 | 7/1977 | Langberg | 331/65 |
| 4,121,657 | 10/1978 | McClure | 175/45 X |
| 4,206,810 | 6/1980 | Blackman | 166/336 |
| 4,468,967 | 9/1984 | Carter, Jr. | 73/661 |
| 4,591,788 | 5/1986 | Mohri et al. | 324/260 |
| 4,638,278 | 1/1987 | Bullock | 335/207 |
| 4,694,283 | 9/1987 | Reeb | 340/572 |
| 4,792,790 | 12/1988 | Reeb | 340/572 |
| 4,835,524 | 5/1989 | Lamond et al. | 340/572 |
| 4,847,552 | 7/1989 | Howard | 324/67 |
| 4,851,815 | 7/1989 | Enkelmann | 340/571 |
| 4,857,851 | 8/1989 | Anderson et al. | 324/326 |
| 4,906,927 | 3/1990 | Urata et al. | 324/238 |
| 4,928,520 | 5/1990 | Barrington | 73/151 |
| 4,933,640 | 6/1990 | Kuckes | 175/45 |
| 4,972,198 | 11/1990 | Feltz et al. | 343/742 |
| 4,990,891 | 2/1991 | Reeb | 340/572 |
| 5,006,800 | 4/1991 | Hedengren et al. | 324/233 |

OTHER PUBLICATIONS

"Review on Recent Advances in the Field of Amorphous-Metal Sensors and Transducers", K. Mohri, IEEE Transactions on Magnetics, vol. MAG-20, No. 5, (Sep. 1984), pp. 942-947.

"Amorphous Magnetic Materials"; Encyclopedia of Chemical Technology, vol. 2, 3rd Ed. (Wiley Interscience, 1980), pp. 537-569.

"Soft Magnetic Materials", Gordon E. Fish; Proceedings of the IEEE, vol. 78, No. 6, (Jun. 1990), pp. 947-972.

*Primary Examiner*—Thuy M. Bui

*Attorney, Agent, or Firm*—Stephen R. Christian; E. Harrison Gilbert, III

[57] ABSTRACT

A system for sensing the passage of a member past a predetermined location along a tubing disposed in an oil or gas well comprises: a magnet connected to the member, the magnet having a soft body so that the magnet can be drilled out by a drill bit lowered into the well after the member has passed the predetermined location; and a sensor, connected to the outside of the tubing at the predetermined location, for detecting a magnetic field of the magnet as the member with the magnet connected thereto passes the sensor. A method for assisting the proper placement of a cement slurry in an oil or gas well comprises: pumping a cement slurry through a tubing into an oil or gas well; releasing a cementing plug into the tubing in series with the cement slurry, the cementing plug having a magnet as referred to above; and sensing the cementing plug at a predetermined location along the tubing, including: generating a null signal in response to providing a biasing magnetic field in opposition to a magnetic field naturally occurring in the tubing at the predetermined location; and changing the null signal to an indicator signal in response to the magnet moving in the tubing to the predetermined location.

20 Claims, 4 Drawing Sheets

DETECTING SYSTEM AND METHOD FOR OIL OR GAS WELL

BACKGROUND OF THE INVENTION

This invention relates generally to a system and method for sensing the passage of a member past a predetermined location along a tubing disposed in an oil or gas well. More particularly, but not by way of limitation, the present invention relates to a system and method for assisting the proper placement of a cement slurry in an oil or gas well.

Various objects may need to be dropped or pumped into an oil or gas well during its creation and completion. For example, when a casing or liner is installed in a well borehole, two cementing plugs may be released on either end of (one in front of and one after) a cement slurry that is pumped through a tubing (which can include the casing or liner itself) into the well. The first, lower cementing plug separates the cementing slurry from the drilling mud or other fluid already in the well, and this first plug drops into the lower part of the well when it reaches the lower end of the tubing (more specifically, it typically lands on a float collar). The second, upper cementing plug separates the cement slurry from a spacer or other following fluid pumped behind the cement slurry to push it around the lower end of the tubing and up the annulus between the casing or liner and an outer tubular or the wall of the borehole. These cementing plugs are typically made of a relatively soft material so that they can be readily drilled out by a conventional drill bit as the depth of the well is increased after the casing or liner has been set.

It is important to know whether the cementing plugs have properly released into the flow stream because if they have not, unwanted mixing between the cement slurry and other fluids can occur, and improper placement of the cement slurry in the well and improper bonding of the casing or liner can result. This need to detect proper release of cementing plugs has been known and attempts to satisfy it have been proposed or made.

Although various types of detectors for detecting the passage of objects, such as cementing plugs, in tubing disposed in oil or gas wells have been disclosed, these types are not necessarily reliably sensitive to the particular object that is to be monitored. For example, a mechanical type of detector may become fouled (such as by becoming cemented) and non-functional in the harsh oil or gas well environment where it is used. As an example of another shortcoming, a type of detector that includes a metallic member mounted on the object may create a drill-out problem if the metallic member is made of a material that cannot be readily drilled by conventional drill bits used in oil or gas wells. In view of at least these shortcomings, there is the need for an improved detector system and method which clearly indicates that the particular object to be monitored has been detected and which does not impede subsequent drill-out.

SUMMARY OF THE INVENTION

The present invention overcomes the above-noted and other shortcomings of the prior art by providing a novel and improved system and method for sensing the passage of a member past a predetermined location along a tubing disposed in an oil or gas well. This invention finds particular utility in assisting the proper placement of a cement slurry in an oil or gas well. The present invention reliably operates to clearly indicate that the particular object to be monitored has been detected. The present invention has mounted on the object a magnetic member made of a soft material that can be readily drilled by a conventional drill bit.

The present invention provides a system for sensing the passage of a member past a predetermined location along a tubing disposed in an oil or gas well, comprising: a magnet connected to the member, the magnet having a soft body so that the magnet can be drilled out by a drill bit lowered into the well after the member has passed the predetermined location; and sensor means, connected to the outside of the tubing at the predetermined location, for detecting a magnetic field of the magnet as the member with the magnet connected thereto passes the sensor means.

The present invention more particularly provides a system for assisting the proper placement of a cement slurry in an oil or gas well, comprising: a cementing plug adapted to be released into a tubing adjacent a cement slurry pumped into the well through the tubing; magnetic means, connected to the cementing plug, for establishing a permanent magnetic field at the cementing plug; and sensor means, connected to the tubing, for sensing the magnetic field as the cementing plug passes the sensor means, the sensor means including: a first pole piece connected to the tubing; a second pole piece connected to the tubing in spaced relation to the first pole piece; a toroidal core retained between the first and second pole pieces; an exciter winding wrapped radially around the circumference of the toroidal core; and a sensing winding wrapped diametrically about the toroidal core overlaying the exciter winding. This system also preferably further comprises a biasing magnet disposed adjacent the sensor means.

The present invention also provides a method for assisting the proper placement of a cement slurry in an oil or gas well, comprising: pumping a cement slurry through a tubing into an oil or gas well; releasing a cementing plug into the tubing in series with the cement slurry, the cementing plug having a bonded rare earth polymer magnet disposed thereon; and sensing the cementing plug at a predetermined location along the tubing, including: generating a null signal in response to providing a biasing magnetic field in opposition to a magnetic field naturally occurring in the tubing at the predetermined location; and changing the null signal to an indicator signal in response to the bonded rare earth polymer magnet moving in the tubing to the predetermined location.

Therefore, from the foregoing, it is a general object of the present invention to provide a novel and improved system and method for sensing the passage of a member past a predetermined location along a tubing disposed in an oil or gas well. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

Figure 1:
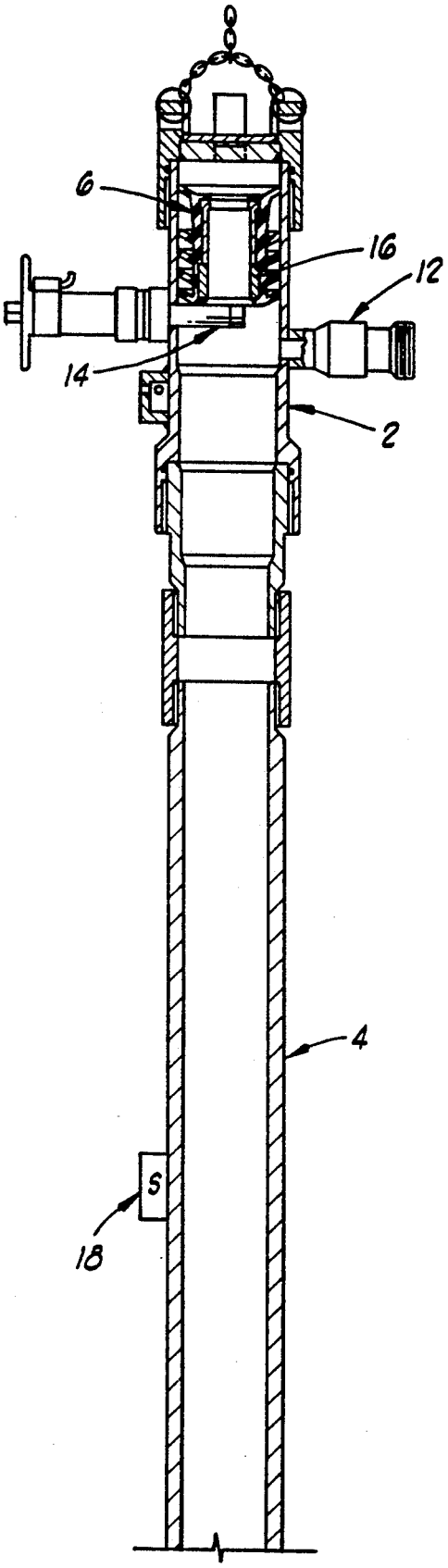
FIG. 1 is a representation of a plug container connected atop a tubing descending into an oil or gas well, wherein a cementing plug is retained within the plug container.
Figure 2:
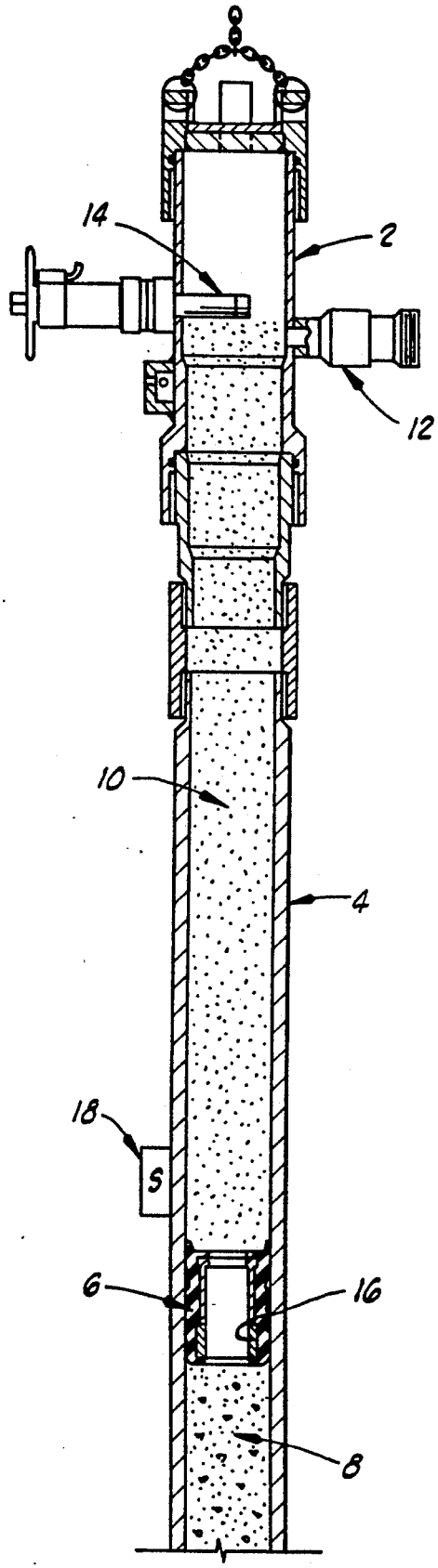
FIG. 2 is a representation as in FIG. 1, but after a cement slurry has been pumped, the plug released and a following fluid pumped.

Referring to FIGS. 1 and 2, a plug container 2 is mounted atop a tubing 4 that extends into an oil or gas well into which a cement slurry is to be pumped to secure casing or a liner, for example. The term "tubing" as used herein and in the claims encompasses any tubular element used in association with an oil or gas well and any string of interconnected such elements. The part of the tubing 4 shown in FIGS. 1 and 2 can be an out-of-hole extension of the casing or liner to be cemented into the borehole of the well (i.e., one or more tubular sections connected to and extending above the casing or liner).

The plug container 2 is a conventional type known in the art. The embodiment shown in the FIGS. 1 and 2 has only one plug 6, but additional plugs can be used with other types of containers or by stacking additional sections to the plug container 2 or by removing the upper cap of the plug container 2 and loading additional plugs. The plug 6 is conventional, except for an element added to it in accordance with the present invention as subsequently described.

The plug 6 is used by being released adjacent a fluid to separate the fluid from a leading or trailing different stage or type of fluid. As represented in FIG. 2, the plug 6 separates a cement slurry 8 from a following mud slurry 10 pumped behind the plug 6 to drive the cement slurry down the tubing 4, around the lower end of the tubing 4 and up the annulus between the tubing 4 and the wall of the well borehole or an outer casing so that the cement slurry 8 can bond the requisite portion of the tubing 4 in the well. This procedure is done in a manner known in the art (e.g., the slurries are pumped into the tubing through inlet coupling 12 attached to the plug container 2, and the plug 6 is released by retracting plunger 14). Additional plugs 6 are used in the same manner. For example, another plug can be released ahead of the cement slurry 8 to separate it from the fluid (e.g., drilling mud) in the well before the cement slurry 8 is pumped into the well.

If the cement slurry 8 is properly placed in the annulus, the leading and trailing plugs 6 (if two such plugs are used) will be at or below the lower end of the tubing 4 because they drop out or land at this point and are not pumped up into the annulus. Once the cement slurry 8 has set so that the casing or liner is held in place, a drill string (not shown) is typically lowered back into the well to drill the borehole deeper. This necessitates drilling out the plugs 6 that have dropped out in known manner during the fluid placement procedure. If the plugs 6, or elements added thereto, are of too hard material, this further drilling can be impeded because the material dulls or damages the cutting or crushing surfaces of the drill bit.

To assist the proper placement of the cement slurry 8 in the oil or gas well by detecting whether each plug 6 has properly released into the fluid stream, the present invention adds a special magnetic member 16 to each such plug 6 and couples a magnetic field responsive sensor device 18 to a predetermined location (i.e., at a selected location where sensing is desired) on the outside of the tubing 4. A typical location is between the plug container 2 and the mouth of the well.

Figure 3:
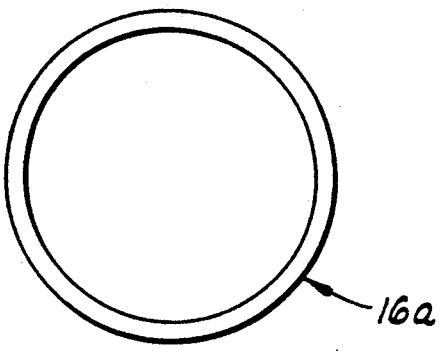
FIG. 3 is an end view of a continuous form of magnet that can be mounted on the plug.
Figure 4:
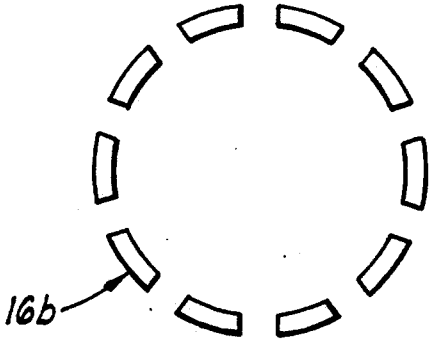
FIG. 4 is an end view of a plurality of magnets that can b mounted the plug at respective radial, circumferentially spaced locations.

The magnetic member 16, shown connected to the member illustrated in FIGS. 1 and 2 as the cementing plug 6, can take any suitable form so long as it establishes a suitable permanent magnetic field at the cementing plug 6. For example, in FIG. 1 the magnetic member 16 is a single magnet having an annular body. In FIG. 3 a continuous ring magnet 16*a* is illustrated. In FIG. 4 there is shown a magnetic member 16*b* having a plurality of magnets each to be disposed at a respective radius of the cementing plug 6 so that the magnets are spaced from each other circumferentially around the body of the cementing plug 6. These various forms of magnets can be used to obtain different magnetic field orientations (e.g., parallel or perpendicular to a longitudinal axis of the plug 6), but it is contemplated that any suitable magnetic body form and magnetic field direction can be used in the present invention so long as the magnetic field interacts with the sensor 18.

Regardless of the particular shape of the magnetic member 16, each body of which the magnetic member 16 is comprised has a soft body so that it can be drilled out by a conventional (e.g., PDC) drill bit lowered into the well after the cementing plug has passed the predetermined sensing location (more specifically, after the cementing procedure has been completed). "Soft body" as used herein and in the claims is limited to mean a magnet made of metal powder bonded together with a hardened polymer resin compound which has cutting properties similar to chalk or gypsum and a mohs hardness of 6 or less. In the preferred embodiment of the present invention, each magnet of the magnetic member 16 includes a bonded rare earth polymer. One specific type of magnet includes neodymium, iron and boron and is marketed under the mark Magnequench I by the Magnequench Division of General Motors; this magnet has a normal residual induction of approximately 6 kilogauss.

Included in the present invention for the purpose of detecting the magnetic field of the magnetic member 16 as the cementing plug 6 passes is the sensor means 18 connected to the outside of the tubing 4 at the predetermined location. Although any suitable type of magnetic field sensor can be used in the broader aspects of the present invention (e.g., Hall effect, fiber optic, Faraday effect), the preferred embodiment sensor means 18 represented in FIGS. 5–8 is a flux gate type.

Referring to FIGS. 5–8, the preferred embodiment sensor device 18 includes two elongated ferrous pole piece bars 20, 22 connected to the tubing 4. The two pole pieces 20, 22 are connected to the tubing 4 in longitudinally aligned, spaced relation to each other. In this orientation, the two pole pieces 20, 22 have facing end surfaces 24, 26, which surfaces preferably are at least in part curved to receive respective portions of a toroidal core 28. Each of the pole pieces 20, 22 of the preferred embodiment has a respective bottom surface in which a respective notch 30 is defined so that the air gaps between the pole pieces 20, 22 and the tubing 4 are reduced and so that the pole pieces are adapted to be mounted on tubing of different diameters.

The sensor device 18 also includes the toroidal core 28 retained between the two pole pieces 20, 22. The core 28 is preferably made of an amorphous material, such as METGLAS 2714A, 2820 MB or 2705M from Allied-Signal (Allied Corporation). An amorphous core is preferred because it has a very sharp knee on the B-H curve; thus, the flux gate has a sharper and higher level output as the core is driven in and out of saturation.

Wrapped radially around the circumference of the toroidal core 28 is an exciter winding 32. The winding 32 is preferably made of 200 turns of #30 gauge copper magnet wire. Wrapped diametrically about the toroidal core 28 overlaying the exciter winding 32 is a sensing winding 34 preferably made of 1,000 turns of #34 gauge copper magnet wire. Kapton tape is wrapped over the windings between two supporting fiberglass boards that are adhered to the core 28 with epoxy applied to the outside surfaces.

Figure 9:
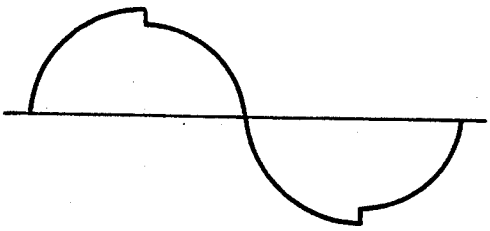
FIG. 9 is a graphical representation of a signal from a sine wave oscillator connected to the exciter winding of the toroidal core shown in FIG. 8.
Figure 8:
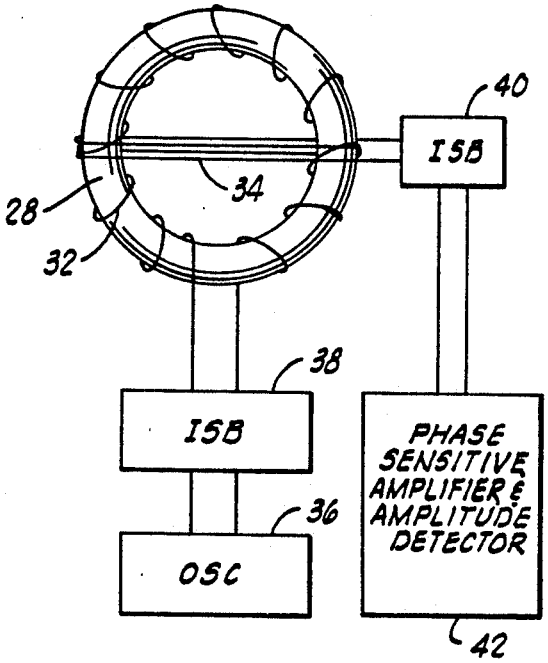
FIG. 8 is a representation of a toroidal core with an exciter winding and a sensing winding used in the sensor embodiment shown in FIG. 5.

The exciter winding 32 connects to an oscillator 36 of moderate output impedance (e.g., less than 1 ohm) through connectors that provide an intrinsically safe barrier 38 of a type known in the art. The flux gate loads the sine wave oscillator 36 as shown in FIG. 9 as the core saturates, and this characteristic can be used to gate the sensing circuitry on the output of the flux gate for noise prevention.

The sensing winding 34 connects through an intrinsically safe barrier 40 to a phase sensitive amplifier and amplitude detector 42 so that an output signal can be obtained and displayed or otherwise used to indicate passage of the plug 6 carrying the magnet 16.

Figure 10:
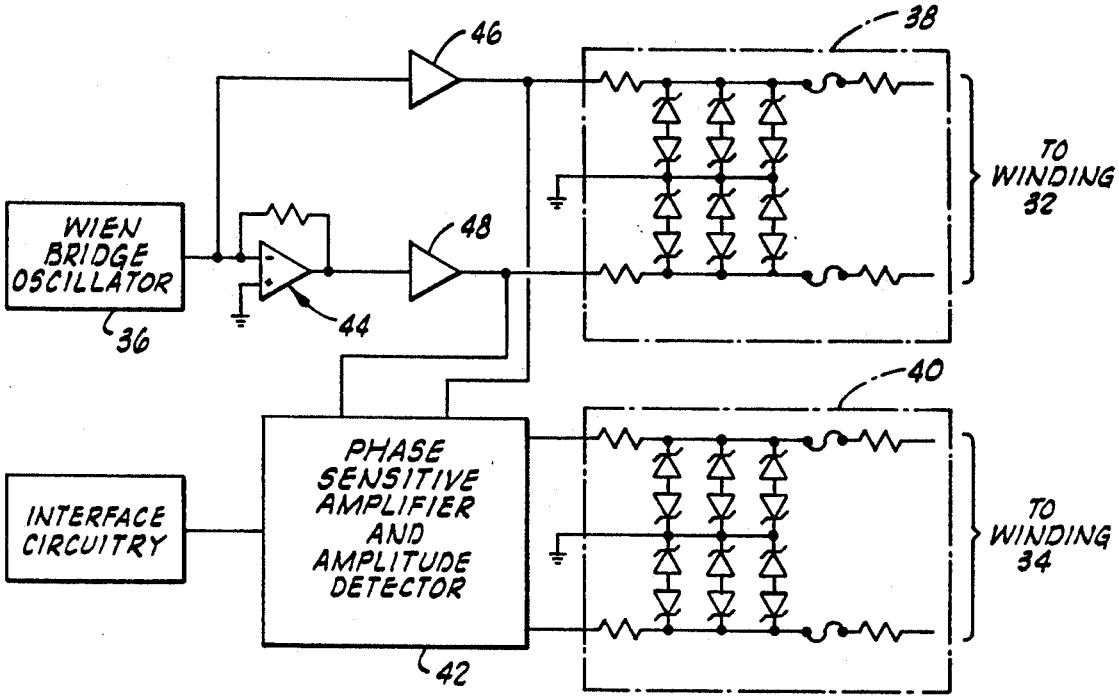
FIG. 10 is a more detailed representation of drive and sensing circuitry of the preferred embodiment.
Figure 11:
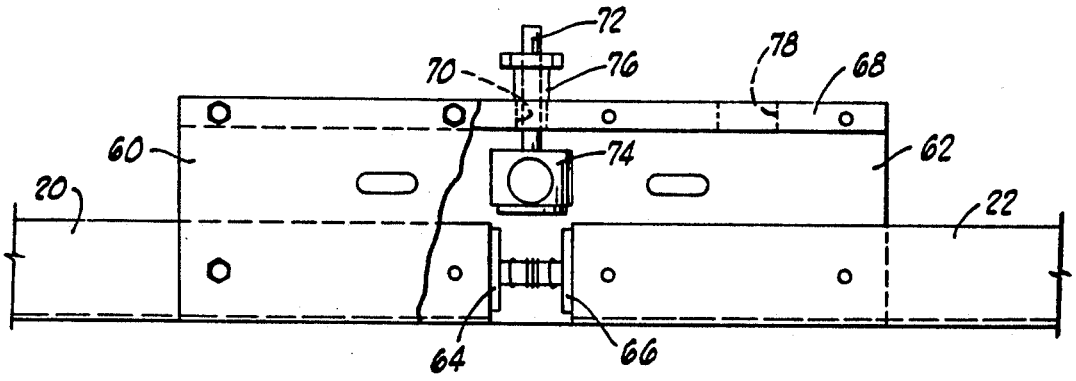
FIG. 11 is a representation in partial cutaway, of a more detailed implementation of the embodiment of FIGS. 5–8.

Referring to an implementation shown in FIG. 10, the oscillator 36 is a Wien bridge type that provides a sine wave output to an inverting unity gain amplifier 44 and buffer amplifiers 46, 48 to drive the exciter winding 32 through the barrier 38 and interconnecting cable. The sensing winding 34 connects to the phase and amplitude detector 42 through a cable and the barrier 40. The barriers 38, 40 limit the maximum current, voltage and open circuit voltage to the windings 32, 34.

Figure 5:
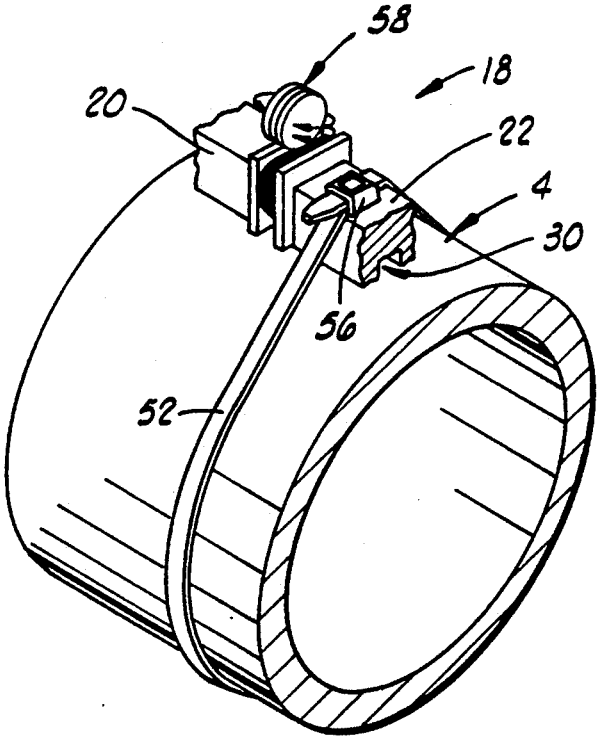
FIG. 5 is a perspective view of a portion of the tubing to which a particular embodiment of a sensor of the present invention is connected.
Figure 6:
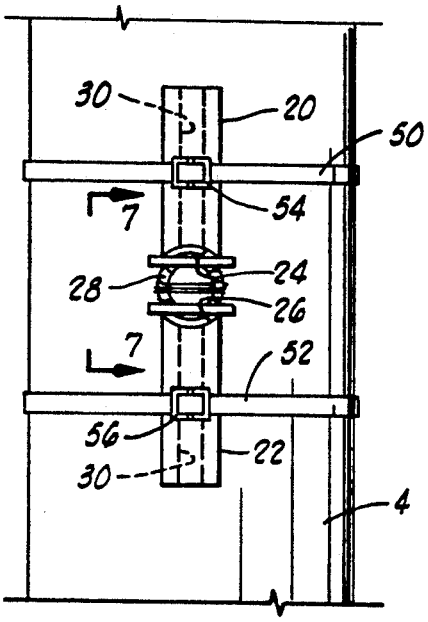
FIG. 6 is an elevational representation of part of the sensor embodiment shown in FIG. 5.
Figure 7:
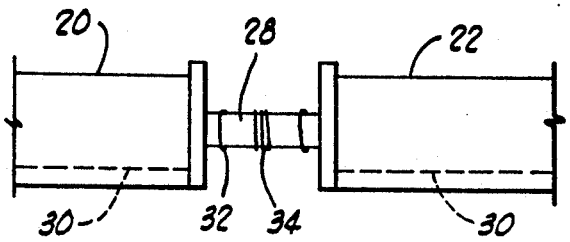
FIG. 7 is a view of the FIG. 6 representation as taken along line 7—7 in FIG. 6.

The sensor device 18 is connected to the tubing 4 by any suitable means. Preferably, and as illustrated in FIGS. 5 and 6, the connection is by two nylon cloth straps 50, 52 passed around the pipe or casing 4 and fastened to the pole piece assembly with fasteners 54, 56, respectively, capable of applying tension to the straps (e.g., ratchet straps).

In the preferred embodiment, the present invention further comprises a biasing magnet 58 movably disposed adjacent the sensor means 18 so that the biasing magnet 58 can be selectably disposed relative to the sensor means 18 and the tubing 4 for canceling a magnetic bias induced in the tubing 4. Flux of naturally occurring magnetism from the earth flowing through the tubing 4 and the sensor 18 can create an offset in the response of the sensor 18. The biasing magnet 58 sets up a counter magnetic flux to counteract the offset and, if desired, to produce a selected overriding bias to enhance the indicating ability of the sensor 18. For example, an output pulse is normally obtained on each half of the sine wave drive. The biasing magnet 58 can be moved, such as by rotation or sliding (e.g., up/down or in/out relative to the tubing 4), to minimize the output pulse on one half of the drive signal (to minimize the saturation of the core). Thus, when a cementing plug 6 with an internal magnet 16 passes the sensor 18, the core 28 is driven further into saturation and out, resulting in a greater change in the amplitude of the output pulse. In a particular implementation, the biasing magnet 58 is an ALNICO magnet providing a residual magnetic flux within the range between about 1000 gauss and 2000 gauss.

A more specific implementation of the embodiment of FIGS. 5–8 is shown in FIG. Like elements are indicated by the same reference numerals used in FIGS. 5–8. Two side plates 60, 62 are connected by screws to the pole pieces 20, 22. Slots are defined in the side plates 60, 62 to receive edges of cards 64, 66 that support the core 28 and its windings 32, 34.

A top plate 68 is connected by screws between the side plates 60, 62. The top plate 68 has a hole 70 that receives a shaft 72 of a holder member 74 that has the biasing magnet 58 secured to it such as by a set screw. The shaft 72 can be rotated to position the biasing magnet 58 at the necessary physical orientation to obtain a desired nulling. A bushing 76 can be tightened to hold the shaft 72 and the member 74 fixed.

The top plate 68 has another hole 78 through which respective cables extend to connect the windings 32, 34 to their respective barriers 38, 40.

The foregoing is for purposes of illustration and is not to be taken as limiting the scope of the present invention.

Using the equipment described above, the method of the present invention comprises disposing the bonded rare earth polymer magnet 16, of selected configuration and orientation, on the cementing plug 6. With the plug 6 (or plugs) loaded in the plug container 2, a cement slurry is pumped through the tubing 4 into the oil or gas well. The cementing plug 6 (or one of them) is released into tubing 4 in series with the cement slurry. Depending on when it is released, the plug 6 moves adjacent either the leading end or the trailing end of the cement slurry 8.

If the cementing plug 6 has properly released and moved with the cement slurry 8, it is sensed at the predetermined location along the tubing 4 where the sensor 18 is disposed. Sensing the cementing plug 6 includes attaching the magnetic field sensor 18 to the tubing 4 at the predetermined location and performing steps of generating a null signal and of changing the null signal using the magnetic field sensor 18 to provide output electrical signals from the electrically conductive outer winding 34 disposed about a diameter of the metallic toroidal core 28 around which the electrically conductive inner winding 32 is disposed radially and circumferentially. In the preferred embodiment, attaching the magnetic field sensor 18 to the tubing 4 includes connecting the two elongated pole pieces 20, 22 longitudinally along the tubing 4 so that the two facing end surfaces 24, 26 are spaced from each other, and connecting the metallic toroidal core 28 within the space between the two pole pieces 20, 22. A flux is set up in the core 28 by current in the exciter winding 32.

The aforementioned step of generating a null signal is performed in response to providing a biasing magnetic field in opposition to a magnetic field naturally occurring in the tubing 4 at the predetermined location. This includes connecting and suitably adjusting the position of the biasing magnet 58 adjacent the sensor 18. Nulling involves canceling the effect of the naturally existing fields so that the sensing winding 34 has zero net flux linkages.

The aforementioned step of changing the null signal to an indicator signal is performed in response to the bonded rare earth polymer magnet 16 moving in the tubing 4 to the predetermined location. When the external field presented by the magnet 16 passes through the core 28, the net flux linked by the sensing winding 34 is no longer zero, which induces a current in the winding 34 proportional to the difference of the external flux and the core flux.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A system for sensing the passage of a member past a predetermined location along a tubing disposed in an oil or gas well, comprising:

a magnet connected to the member, said magnet having a soft body so that said magnet can be drilled out by a drill bit lowered into the well after the member has passed the predetermined location; and sensor means, connected to the outside of the tubing at the predetermined location, for detecting a magnetic field of said magnet as the member with said magnet connected thereto passes said sensor means.

2. A system as defined in claim 1, wherein said soft body includes a bonded rare earth polymer.

3. A system as defined in claim 2, wherein said bonded rare earth polymer includes neodymium, iron and boron.

4. A system as defined in claim 1, wherein said soft body is formed as a continuous ring.

5. A system as defined in claim wherein said system includes a plurality of magnets, each having a respective soft body disposed at a respective radius of the member so that said plurality of magnets are spaced from each other circumferentially around the member.

6. A system as defined in claim 1, further comprising a biasing magnet movably disposed adjacent said sensor means so that said biasing magnet can be selectably disposed relative to said sensor means and the tubing for canceling a magnetic bias induced in the tubing.

7. A system for assisting the proper placement of a cement slurry in an oil or gas well, comprising:

a cementing plug adapted to be released into a tubing adjacent a cement slurry pumped into the well through the tubing;

magnetic means, connected to said cementing plug, for establishing a permanent magnetic field at said cementing plug; and sensor means, connected to the tubing, for sensing the magnetic field as said cementing plug passes said sensor means, said sensor means including:

a first pole piece connected to the tubing;

a second pole piece connected to the tubing in spaced relation to said first pole piece;

a toroidal core retained between said first and second pole pieces;

an exciter winding wrapped radially around the circumference of said toroidal core; and a sensing winding wrapped diametrically about said toroidal core overlaying said exciter winding.

8. A system as defined in claim 7, further comprising a biasing magnet disposed adjacent said sensor means.

9. A system as defined in claim 7, wherein said first and second pole pieces have facing end surfaces curved to receive respective portions of said toroidal core.

10. A system as defined in claim 7, wherein each of said first and second pole pieces has a respective bottom surface in which a notch is defined so that said first and second pole pieces are adapted to be mounted on tubing strings of different diameters.

11. A system as defined in claim 7, wherein said magnetic means includes a bonded rare earth polymer.

12. A system as defined in claim 11, wherein said bonded rare earth polymer includes neodymium, iron and boron.

13. A system as defined in claim 7, wherein said magnetic means includes a magnet formed in a continuous ring.

14. A system as defined in claim 7, wherein said magnetic means includes a plurality of magnets, each having a respective soft body disposed at a respective radius of said cementing plug so that said magnets are spaced from each other circumferentially around said cementing plug.

15. A method for assisting the proper placement of a cement slurry in an oil or gas well, comprising:

pumping a cement slurry through a tubing into an oil or gas well;

releasing a cementing plug into the tubing in series with the cement slurry, the cementing plug having a bonded rare earth polymer magnet disposed thereon; and sensing the cementing plug at a predetermined location along the tubing, including:

generating a null signal in response to providing a biasing magnetic field in opposition to a magnetic field naturally occurring in the tubing at the predetermined location; and changing the null signal to an indicator signal in response to the bonded rare earth polymer magnet moving in the tubing to the predetermined location.

16. A method as defined in claim 15, wherein sensing the cementing plug further includes attaching a magnetic field sensor to the tubing at the predetermined location and performing said steps of generating a null signal and of changing the null signal using the magnetic field sensor to provide output electrical signals from an electrically conductive outer winding disposed about a diameter of a metallic toroidal core having an electrically conductive inner winding disposed radially and circumferentially around the metallic toroidal core.

17. A method as defined in claim 16, wherein attaching a magnetic field sensor to the tubing includes connecting two elongated pole pieces longitudinally along the tubing so that two facing end surfaces of the two pole pieces are spaced from each other, and connecting the metallic toroidal core within the space between the two pole pieces.

18. A method as defined in claim 17, wherein generating a null signal in response to providing a biasing magnetic field includes connecting a biasing magnet adjacent the assembly of the two pole pieces and the metallic toroidal core.

19. A method as defined in claim 15, further comprising disposing the bonded rare earth polymer magnet on the cementing plug as a continuous magnetic ring.

20. A method as defined in claim 15, further comprising disposing the bonded rare earth polymer magnet on the cementing plug as a plurality of radially oriented, circumferentially spaced magnetic members.

* * * * *